United States Patent [19]

Perry

[11] Patent Number: 4,896,571

[45] Date of Patent: Jan. 30, 1990

[54] PLUMBING TOOL

[76] Inventor: Harold Perry, 6406 E. 11th, Wichita, Kans. 67206

[21] Appl. No.: 217,753

[22] Filed: Jul. 7, 1988

[51] Int. Cl.[4] ..... B25B 13/04

[52] U.S. Cl. ..... 81/120; 81/124.3

[58] Field of Search ..... 81/120, 121.1, 124.3, 81/124.7, 176.1, 176.2, 176.3, 3.4

[56] References Cited

U.S. PATENT DOCUMENTS

| | | | |
|---|---|---|---|
| 1,228,951 | 6/1917 | Morton | 81/3.4 |
| 1,329,560 | 2/1920 | Thomas | 81/121.1 |
| 1,838,278 | 12/1931 | Montagnon | 81/176.1 |
| 3,231,955 | 2/1966 | Taylor | 81/120 |

*Primary Examiner*—Judy Hartman

*Attorney, Agent, or Firm*—John W. Carpenter

[57] ABSTRACT

A plumbing tool having a ring with a circular structure defining an opening that extends through the circular structure. The circular structure is formed with a slot, and a pair of threaded apertures are disposed on opposite sides of the opening in order to communicate with the same. Each of the threaded apertures terminate in a recess disposed within the circular structure and communicating with the respective threaded aperture. A bolt threadably passes through the pair of threaded apertures for winding and narrowing the opening. A second pair of threaded apertures extend through the circular structure in a generally opposed relationship for threadably receiving a pair of handles.

1 Claim, 4 Drawing Sheets

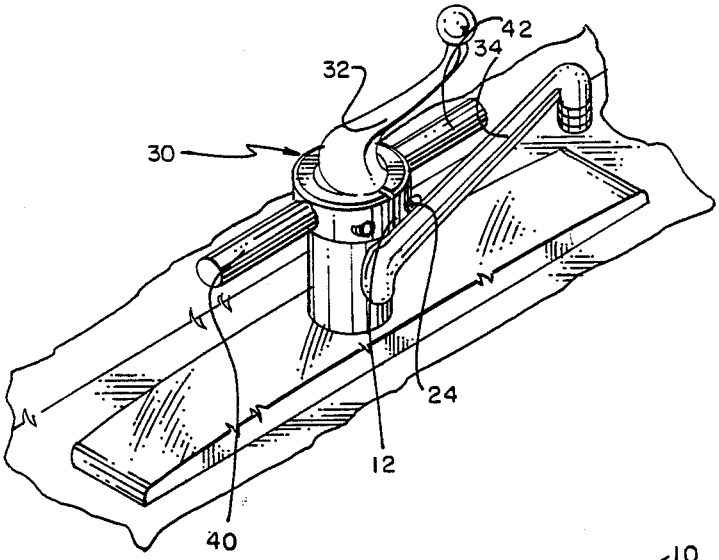
FIG. 1
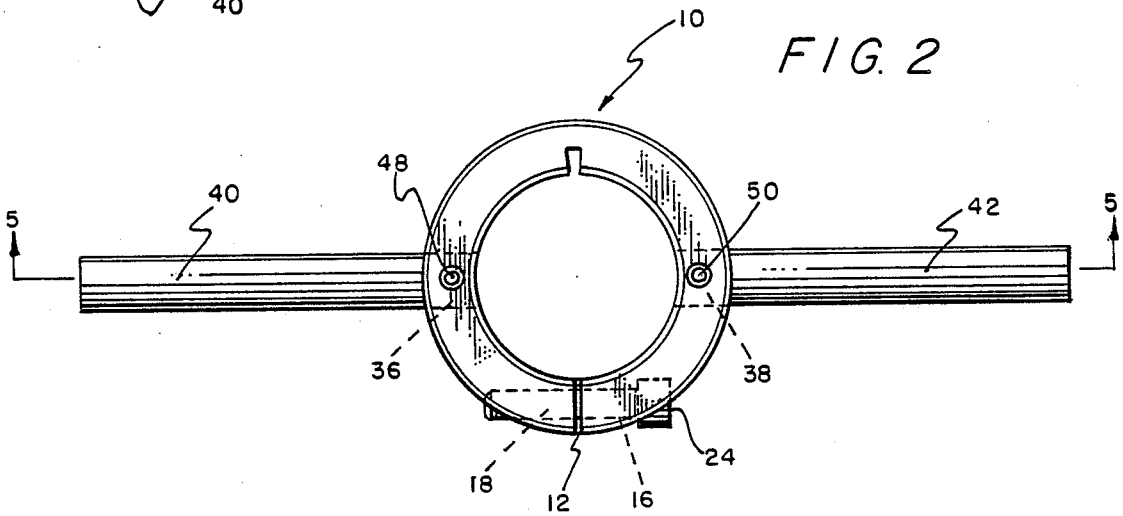
FIG. 2
FIG. 3
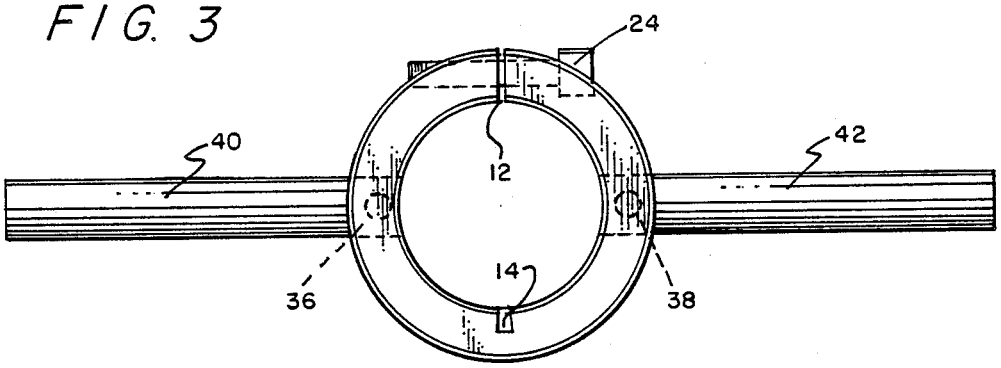
FIG. 4
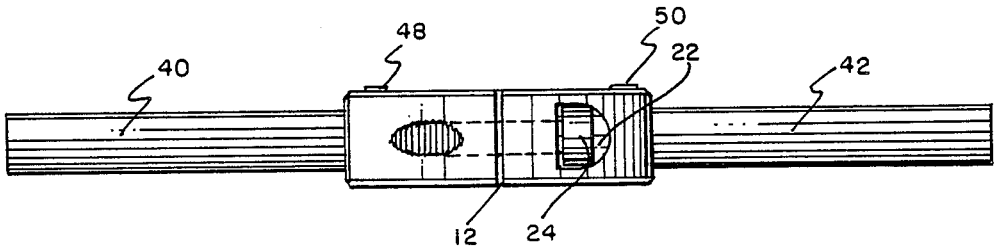

FIG. 5
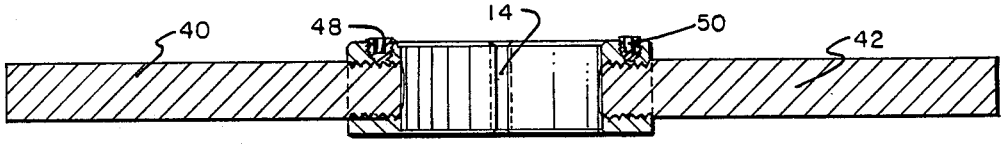
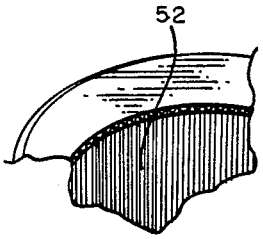
FIG. 10
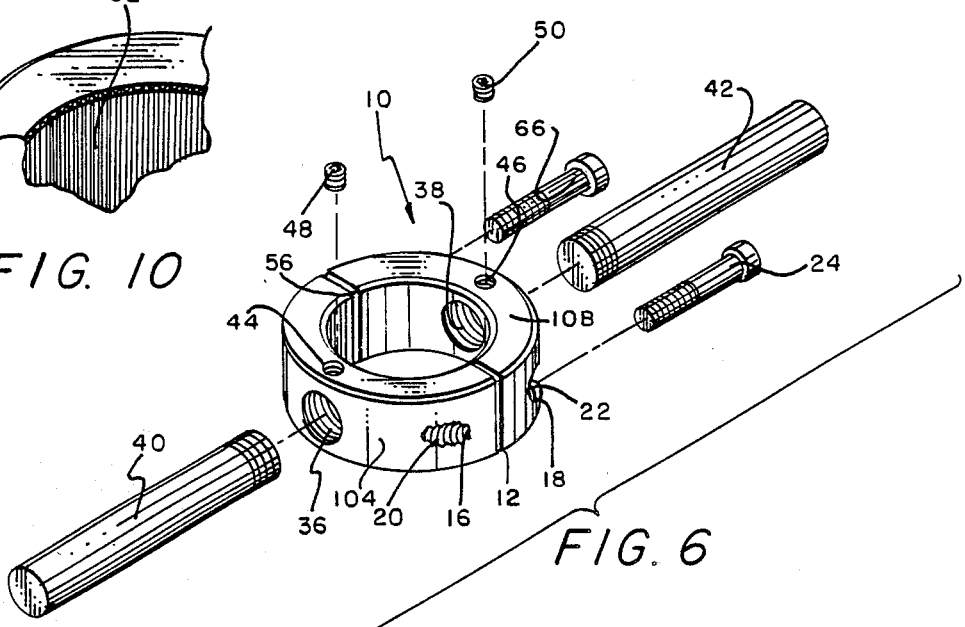
FIG. 6
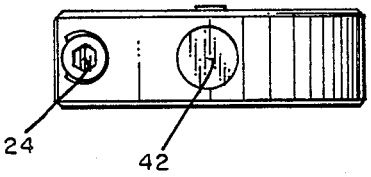
FIG. 7
FIG. 8
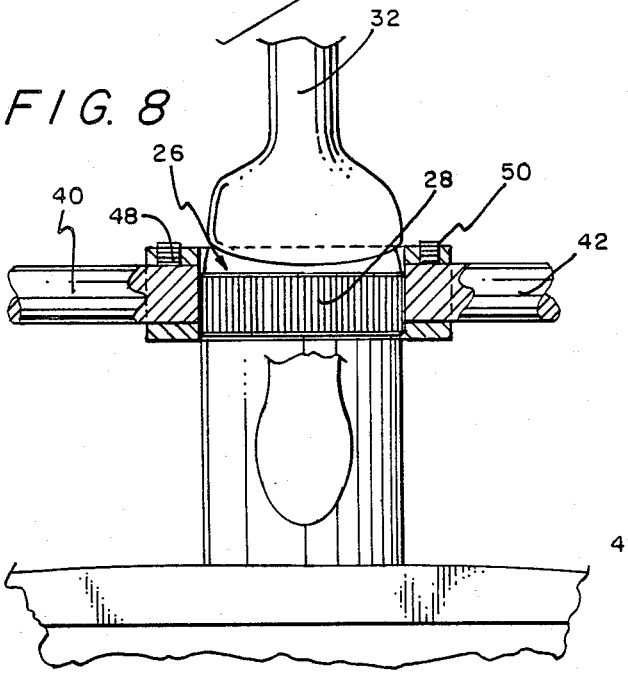
FIG. 9
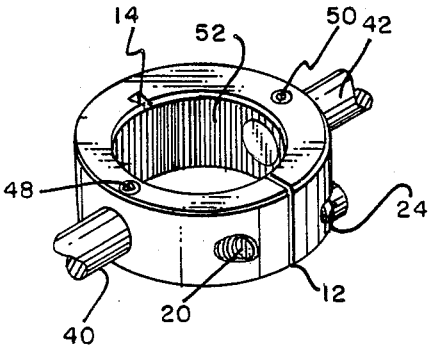

FIG. 15
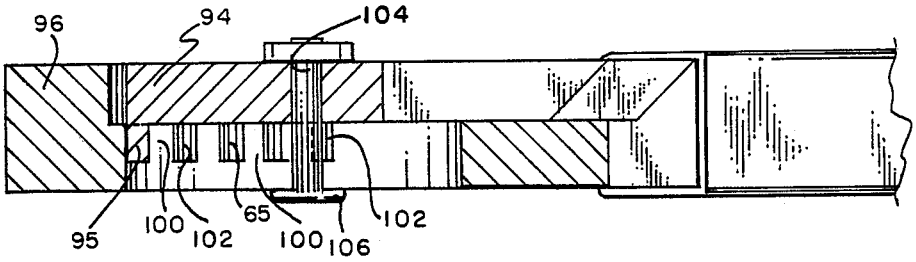
FIG. 16
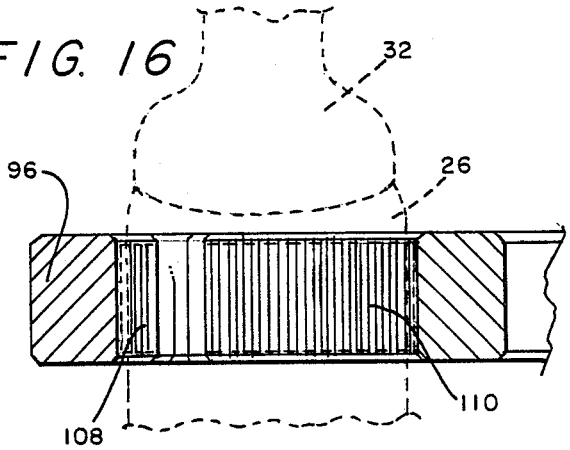
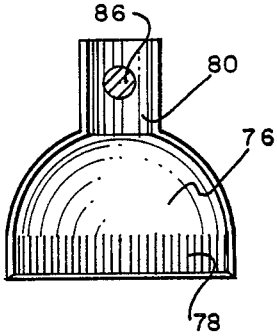
FIG. 20
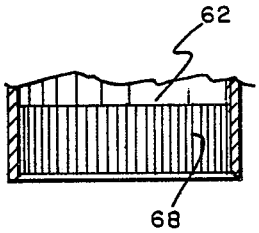
FIG. 18
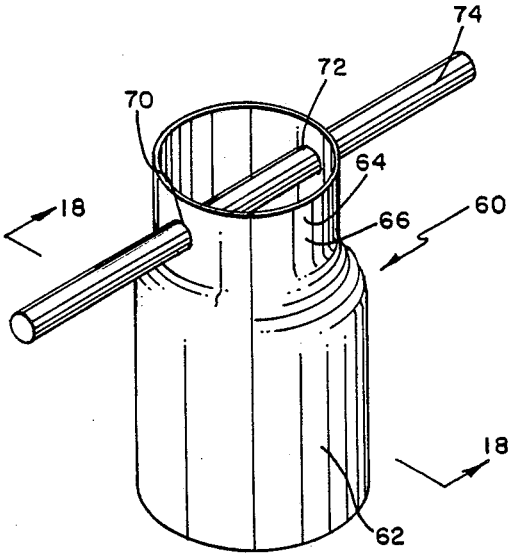
FIG. 17
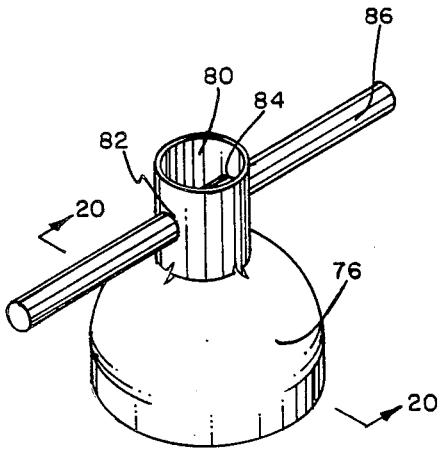
FIG. 19

PLUMBING TOOL

1. FIELD OF THE INVENTION

This invention is related to a plumbing tool. More specifically, this invention provides for a plumbing tool that is capable of being situated around or over certain dome-shaped cap assemblies that are part of faucets sold under the registered trademark DELTA, a registered trademark of the Delta Company.

2. DESCRIPTION OF THE PRIOR ART

A patentability investigation was conducted and the following U.S. Pat. Nos. were discovered: 1,838,278 to Montagnon; 2,338,753 to Flessner; 2,766,648 to Jazwieck; 2,846,910 to Brown; 3,231,955 to Taylor; and 3,656,793 to Mathews. None of the foregoing prior art teaches or suggests the particular plumbing tool of this invention.

SUMMARY OF THE INVENTION

The present invention accomplishes its desired objects by providing a plumbing tool having a number of specific embodiments. In one embodiment the plumbing tool includes a ring means having a circular structure defining an opening extending through the circular structure. A channeled slot is disposed within the circular structure. The circular structure additionally includes a pair of threaded apertures that communicate with the opening. The pair of threaded apertures are in an opposed aligned relationship with respect to each other. Each of the threaded apertures terminate in a recess disposed within the circular structure and communicating with the respective threaded aperture. A bolt means slidably passes through the pair of threaded apertures for widening and narrowing the opening. The circular structure additionally includes another pair of threaded apertures extending therethrough for threadably receiving a pair of threaded handles.

In another embodiment of the plumbing tool, there is provided a ring means which is divided into a first semi-circular section and into a second semi-circular section. The first semi-circular section has a pair of first ends and a pair of first threaded apertures with one of the first threaded apertures extending through one of the first ends and another first threaded aperture extending through the other first end. Similarly, the second semi-circular section has a pair of second ends and a pair of second threaded apertures. One of the second threaded apertures extends through one of the second ends and the other threaded aperture extends through the other second end. This embodiment of the plumbing tool includes a pair of bolts. One bolt threadably engages one of the first threaded apertures and one of the second threaded apertures, while the other bolt threadably engages the other first threaded aperture and the other second threaded aperture. Each of the semi-circular sections have a structure defining a central threaded aperture for threadably receiving a pair of threaded handle members. The first semi-circular section and the second semi-circular section additionally have a first top threaded aperture and a second top threaded aperture, respectively.

In another embodiment for the plumbing tool of this invention, there is provided a hollow generally cylindrical body means having a lower hollow cylindrical body with a lower circular structure having a plurality of teeth. The cylindrical body means also includes an upper hollow cylindrical body that is integrally bound to the lower hollow cylindrical body. The upper hollow cylindrical body has a pair of diametrically opposed apertures wherethrough a handle is slidably disposed.

In yet another embodiment for the plumbing tool, a hollow dome-shaped body is provided with a circular perimeter that has a structure defining a plurality of teeth. An upper hollow cylindrical body is integrally bound to the dome-shaped body and has a structure with a pair of diametrically opposed apertures wherethrough a handle is slidably disposed.

In still yet another embodiment for the plumbing tool, there will be seen a first handle member formed with a first semi-circular jaw, and a second handle member typically secured to the first handle member and formed with a second semi-circular jaw. The first jaw and the second jaw each have a structure defining a plurality of teeth. The second handle member has an elongated slot and a plurality of arcuate channels. A bolt means slidably passes through the first handle and through the elongated slot to secure on a side of the second handle member in order to pivotally secure the first handle member to the second handle member. The first handle member is adaptable to move the bolt means into and out of engagement with one of the arcuate channels to adjust the opening between the first semi-circular jaw and the second semi-circular jaw.

It is therefore an object of the present invention to provide a plumbing tool.

Other objects will become apparent to those skilled in the art as the following description proceeds.

These, together with various ancillary objects and features which will become apparent to those skilled in the art as the following description proceeds, are attained by this novel plumbing tool, a preferred embodiment being shown with reference to the accompanying drawings, by way of example only, wherein:

BRIEF DESCRIPTION OF THE DRAWINGS

FIG. 1 is a perspective view of one of the embodiments of the plumbing tool engaged to a cap assembly of a faucet sold under the registered trademark Delta;

FIG. 2 is a top plan view of one embodiment of the plumbing tool;

FIG. 3 is a bottom plan view of the embodiment of the plumbing tool of FIG. 2;

FIG. 4 is a side elevational view of the plumbing tool of FIG. 2;

FIG. 5 is a vertical sectional view taken in direction of the arrows and along the plane of line 5—5 in FIG. 2;

FIG. 6 is a perspective segmented view of another embodiment of the plumbing tool;

FIG. 7 is an end elevational view of the embodiment of the plumbing tool of FIG. 2;

FIG. 8 is a partial vertical sectional view of one embodiment of the plumbing tool engaged around the serrated sides of a cap assembly that is part of a faucet sold under the registered trademark Delta;

FIG. 9 is a partial perspective view of the embodiment of the plumbing tool of FIG. 2;

FIG. 10 is a partial perspective view of the inside circular structure of the plumbing tool having a plurality of teeth;

FIG. 15 is a vertical sectional view taken in direction of the arrows and along the plane of line 15—15 in FIG. 14;

FIG. 16 is a vertical sectional view taken in direction of the arrows and along the plane of line 16—16 in FIG. 14;

FIG. 17 is a perspective view of yet another embodiment of the plumbing tool;

FIG. 18 is a vertical sectional view taken in direction of the arrows and along the plane of line 18—18 in FIG. 17;

FIG. 19 is still yet another embodiment of the plumbing tool of this invention;

FIG. 20 is a vertical sectional view taken in direction of the arrows and along the plane of line 20—20 in FIG. 19.

DETAILED DESCRIPTION OF THE INVENTION

Figure 11:
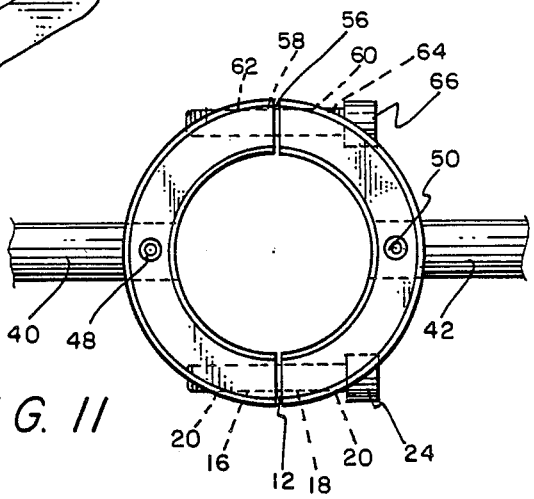
FIG. 11 is a top plan view of the embodiment of the plumbing tool of FIG. 6.
Figure 14:
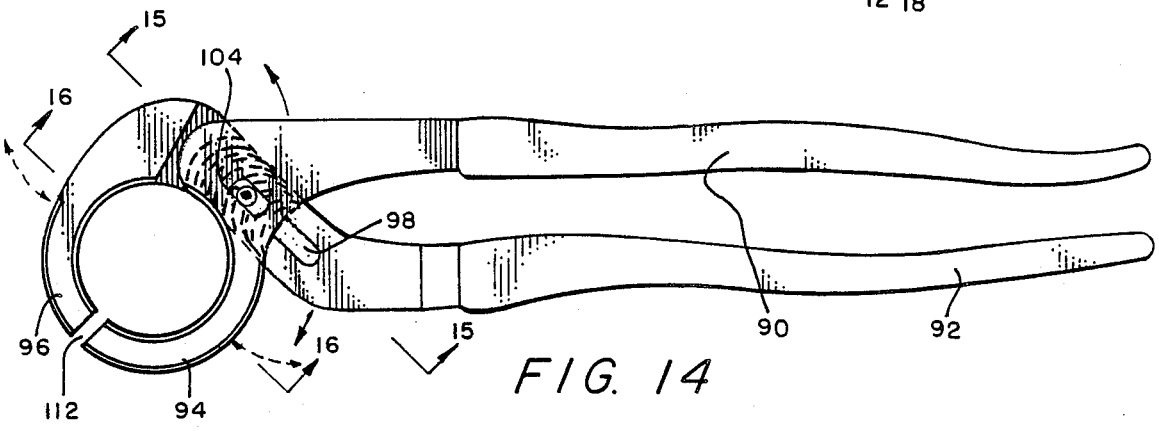
FIG. 14 is a top plan view of the embodiment of the plumbing tool of FIG. 13.
Figure 13:
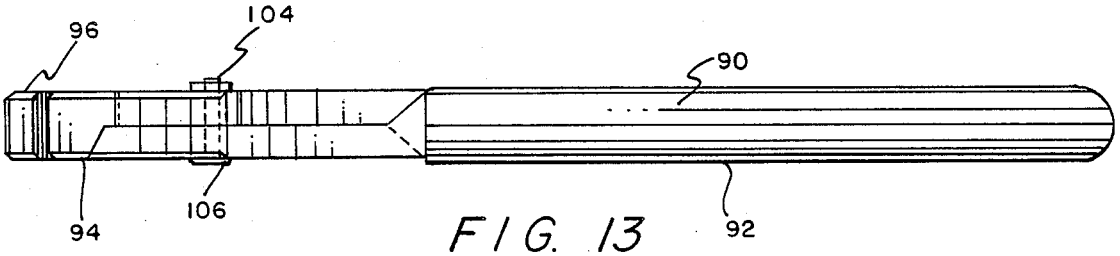
FIG. 13 is a side elevational view of the embodiment of the plumbing tool of FIG. 12.

The present invention comprises a plumbing tool having various embodiments. One preferred embodiment is shown in FIGS. 1–5, 7, 8, and 9; and a second embodiment is illustrated in FIGS. 6 and 11. FIGS. 12–15 illustrate yet another embodiment for the plumbing tool, whereas FIGS. 17, 18 and FIGS. 19, 20 illustrate a fourth and fifth embodiment, respectively, of the plumbing tool.

In the two embodiments for the plumbing tool disclosed in FIGS. 1–5, 7, 8, and 9, and FIGS. 6 and 11, there is seen the plumbing tool comprising a ring, generally illustrated as 10. As best illustrated in FIG. 2, for one embodiment of the plumbing tool the ring 10 defines an opening 12 extending through the circular structure of the ring 10. The circular structure of the ring 10 also has a channeled slot 14 and a pair of threaded apertures 16 and 18 (see FIGS. 2 and 6) which communicate with the opening 12 and are disposed in an opposed aligned relationship with respect to each other. The threaded apertures 16 and 18 terminate in recesses 20 and 22, respectively, disposed within the circular structure of the ring 10. A bolt 24 threadably passes through the pair of threaded apertures 16 and 18 such that by turning the bolt 24 in a predetermined direction, the opening 12 may be widened or narrowed. It is readily apparent that as the bolt is rotated counterclockwise (or tightened) the opening 12 is narrowed such that if the ring structure is secured to a cap assembly, generally illustrated as 26 in FIG. 8, tightening of the bolt 24 causes the ring structure to tighten around the cap assembly 26, more specifically around a plurality of teeth 28 that circumscribe the cap assembly 26. As was previously indicated, the cap assembly 26 is part of a faucet assembly, generally illustrated as 30 that, in addition to the cap assembly 26, includes handle 32, and spigot 34.

The plumbing tool of FIGS. 1–5, 7–9, and FIGS. 6 and 11 additionally comprise threaded apertures 36 and 38 which extend through the circular structure of the ring 10. A pair of threaded handles 40 and 42 is threadably secured within the threaded apertures 36 and 38 respectively. In order to firmly affix the pair of handles 40 and 42 within the threaded apertures 36 and 38, the circular structure of the ring 10 is provided with a pair of top threaded apertures 44 and 46 respectively communicating with threaded apertures 36 and 38, and wherein a pair of threaded bolts 48 and 50 respectively rotatably lodge such that upon tightening, the bolts 48 and 50 can respectively tighten against handles 40 and 42 to provide a stationary lodging of the handles 40 and 42 within the threaded apertures 36 and 38. The circular structure of the ring 10 may be formed with a plurality of teeth 52 such as to be capable of mating and engaging with the teeth 28 of the cap assembly 26.

With respect to the plumbing tool of FIGS. 6 and 11, instead of being formed with the channeled slot 14, the circular structure of the ring is divided into two semicircular sections, 10A and 10B. The semi-circular sections 10A and 10B are separated by opening 12 and opening 56. Opposed in an aligned relationship and being separated by opening 56 is a pair of threaded apertures 58 and 60 which are the mirror image of apertures 16 and 18 respectively. Similarly to threaded apertures 16 and 18 respectively terminating in recesses 20 and 22, threaded apertures 58 and 60 respectively terminate into recesses 62 and 64. Bolt 66 threadably passes through apertures 58 and 60, similarly to bolt 24 passing through threaded apertures 16 and 18, in order that by tightening bolt 66 the opening 56 is narrowed. It is readily apparent that by loosening bolt 66, the opening 56 would widen.

As best illustrated in FIG. 6, semi-circular section 10A comprises threaded aperture 16, recess 20, threaded aperture 36 wherethrough handle 40 rotatably passes into in order to be stationarily secured therein by threaded bolt 48 passing through threaded aperture 44, threaded aperture 58, and recess 62.

Semi-circular section 10B is a mirror image of semicircular section 10A. More specifically, semi-circular section 10B includes threaded aperture 18, recess 22, threaded aperture 38 wherethrough handle 42 threadably passes in order to be stationarily secured therein by a threaded bolt 50 passing into threaded aperture 46, threaded aperture 60, and recess 64. Each of the semicircular sections 10A and 10B may be formed with teeth 52.

In operation for the plumbing tool of FIGS. 1–5, 7–10, and FIGS. 6 and 11, the handle 32 (see FIG. 1) is passed through the circular opening which the circular structure of the ring 10 defines until the latter has lodged around the teeth 28 of the cap assembly 26, as illustrated in FIGS. 1 and 8. When the circular structure of the ring has been disposed as such, bolt 24 (and bolt 66 in the event that the plumbing tool of FIGS. 6 and 11 is being employed) is tightened such that the circular structure of the plumbing tool has firmly engaged the teeth 28 of the cap assembly 26. The handles 40 and 42 may be easily employed now to turn cap assembly 26 in a predetermined direction in order to loosen the same for removal.

Turning now to FIGS. 17–20 for two other embodiments of the plumbing tool, there is seen in FIGS. 17 and 18 a hollow generally cylindrical body, generally illustrated as 60, comprised of a lower hollow cylindrical body 62 and an upper hollow cylindrical body 64 integrally bound to the top of the lower cylindrical body 62. The upper body 64 has a smaller diameter than the lower body 62 such that a tapering surface 66 is employed to interconnect the lower part of the upper body 64 with the upper part of the lower body 62. The lower body has a circular structure whose inside face is formed with a plurality of teeth 68, as illustrated in FIG. 18. The upper body includes a pair of opposed apertures that are diametrically situated with respect to each other. Slidably passing through the apertures 70 and 72 is a handle 74.

In FIGS. 19 and 20 the plumbing tool comprises a hollow dome-shaped body 76 whose lower portion thereof is internally formed with a plurality of teeth 78, as illustrated in FIG. 20. Integrally bound to the dome-shaped body, and generally axially aligned therewith, is an upper hollow cylindrical body 80. Similarly to hollow body 64, upper cylindrical body 80 is formed with diametrically opposed apertures 82 and 84 wherethrough a handle 86 may slidably pass.

In operation of the preferred embodiments of the plumbing tool of FIGS. 17–20, the cap assembly (with the handle 32 removed) is merely encircled with the lower part of the hollow cylindrical body 62 or the dome-shaped body 76 such that either the plurality of teeth 68 or 78 mate with and firmly lock between teeth 68 on the cap assembly 26. In such a position, the plumbing tool of FIGS. 17 and 18 and the plumbing tool of Figs. 19 and 20 may be easily turn the cap assembly 26 with the handles 74 and 86 respectively.

Figure 12:
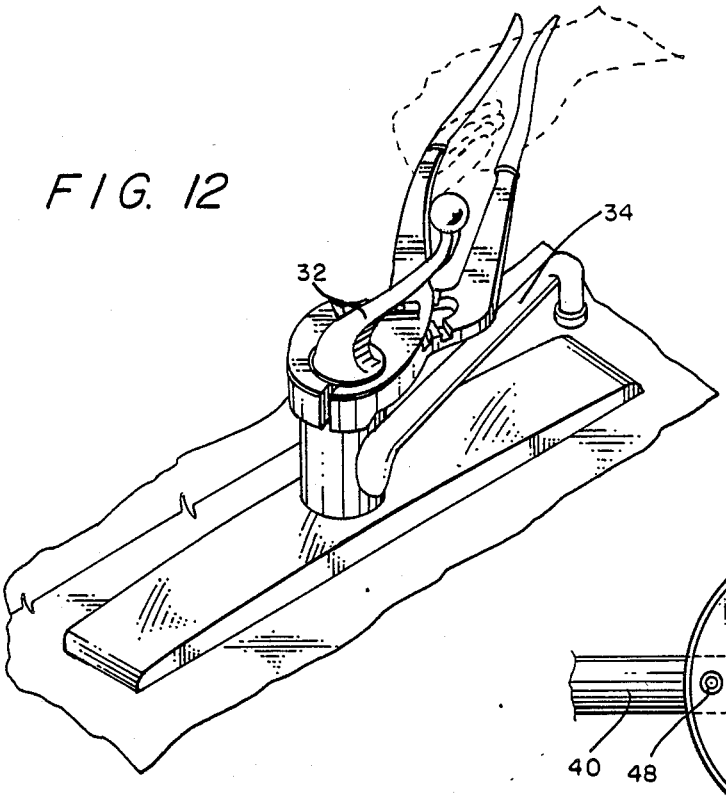
FIG. 12 is a perspective view of another embodiment of the plumbing tool engaged around the cap assembly of a Delta® faucet.
Figure 21:
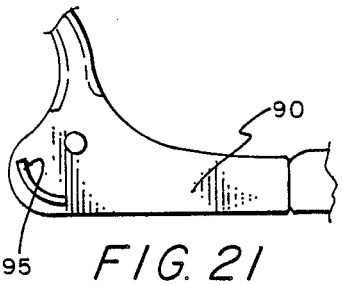
FIG. 21 is a partial plan view of one of the handles of the plumbing tool of FIG. 13 with an arcuate protrusion.

The final embodiment for the plumbing tool of this invention is that embodiment illustrated in FIGS. 12–16 and 21. In this embodiment of the invention, the plumbing tool comprises a first handle 90 and a second handle 92 pivotally secured to the first handle 90. The first handle 90 is formed with a semi-circular jaw 94 and with an arcuate protrusion 95 extending above the surface thereof. Similarly, handle 92 is formed with a semi-circular jaw 96, and with an elongated slot 98. The elongated slot 98 has along its boundaries a plurality of arcuate channels 100 that are formed by and separated by partitions 102. Arcuate protrusion 95 removably lodges within a particular concrete channel 100 to fix the opening of the jaws 94 and 96 at a particular diameter. A bolt 104 slidably passes through the handle 90, through the elongated slot 98, and terminates in a washer or flange means 106 to firmly pivotally secure together the handle 90 with the handle 92. The semi-circular jaw 96 may be formed with teeth 108, and the semi-circular jaw 94 may be formed with teeth 110. Teeth 108 and 110 are adaptable to engage teeth 28 of the cap assembly, as illustrated in FIG. 12. Handle 92 is adaptable to move the arcuate protrusion 95 into and out of engagement with the arcuate channels 100, more specifically the partitions 102, in order to adjust an opening 112 between the end of the semi-circular jaw 94 and the end of the semi-circular jaw 96. Such adjustment can be accomplished by moving pivotally the handles 90 and 92 away from each other about to extreme points, thus moving arcuate protrusion 95 out of any arcuate channel 100 and enabling the bolt 104 to slide readily within slot 98 to either enlarge or lessen opening 112, depending on the direction of movement.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A plumbing tool comprising a ring means divided into a first semi-circular section and into a second semi-circular section, said first semi-circular section having a pair of first ends and a pair of first threaded apertures with one first threaded aperture extending through one of the first ends and the other first threaded aperture extending through the other first end, each of said first threaded apertures terminate in a first recess disposed within the first semi-circular section and communicating with the respective first threaded aperture; said second semi-circular section having a pair of second ends and a pair of second threaded apertures with one second threaded aperture extending through one of the second ends and the other second threaded aperture extending through the other second end; each of said second threaded apertures terminate in a second recess disposed within the second semi-circular section and communicating with the respective second threaded aperture; a first threaded bolt means threadably engaging one of the first threaded apertures and one of the second threaded apertures and extending through one of said first recesses and one of said second recesses; a second threaded bolt means threadably engaging the other first threaded aperture with the other second threaded aperture and extending through the other of said first recesses and the other of said second recesses; said first semi-circular section having a structure defining a first central threaded aperture and a first top threaded aperture communicating with said first central threaded aperture and said second semi-circular section having a structure defining a second central threaded aperture and a second top threaded aperture communicating with said second central threaded aperture; and a pair of threaded handles, with one threaded handle threadably secured within said first central threaded aperture and with the other threaded handle threadably secured within said second central threaded aperture; a pair of handle-engaging threaded bolt means threadably engaged within said first and second top threaded apertures respectively for lodging against the pair of threaded handles; said first semi-circular section has a structure defining a first plurality of teeth on an interior surface of said first semi-circular section, and said second semi-circular section has a structure defining a second plurality of teeth on an interior surface of said second semi-circular section has been added after teeth.

* * * * *